US005542393A

United States Patent [19]

Katoh et al.

[11] Patent Number: 5,542,393

[45] Date of Patent: Aug. 6, 1996

[54] FUEL INJECTION AMOUNT CONTROL SYSTEM FOR INTERNAL COMBUSTION ENGINES

[75] Inventors: Akira Katoh; Hiroshi Kitagawa; Shunichi Tsuzuki; Jun Takahashi; Sachito Fujimoto; Toshiaki Hirota, all of Wako, Japan

[73] Assignee: Honda Giken Kogyo Kabushiki Kaisha, Tokyo, Japan

[21] Appl. No.: 334,338

[22] Filed: Nov. 2, 1994

[30] Foreign Application Priority Data

Nov. 2, 1993 [JP] Japan ..... 5-297470

[51] Int. Cl.[6] ..... F02D 41/00

[52] U.S. Cl. ..... 123/491; 123/492; 123/493

[58] Field of Search ..... 123/491, 492, 123/493, 480

[56] References Cited

U.S. PATENT DOCUMENTS

| | | | |
|---|---|---|---|
| 4,357,923 | 11/1982 | Hideg | 123/492 |
| 5,031,597 | 7/1991 | Monden | 123/492 |
| 5,080,071 | 1/1992 | Minamitani et al. | 123/492 X |

FOREIGN PATENT DOCUMENTS 1-305142 12/1989 Japan .

*Primary Examiner*—Tony M. Argenbright
*Attorney, Agent, or Firm*—Nikaido, Marmelstein, Murray & Oram LLP

[57] ABSTRACT

A fuel injection amount control system for an internal combustion engine includes an ECU which calculates a desired amount of fuel to be supplied to each combustion chamber in response to operating conditions of the engine, and calculates values of parameters indicative of fuel adherence characteristics of the interior of the intake passage in response to operating conditions of the engine. The ECU further calculates a first fuel amount which is directly drawn into the combustion chamber from a fuel amount injected by the fuel injection valve, and a second amount of fuel which is carried off the wall surface of the intake passage due to evaporation and drawn into the combustion chamber, based upon the values of the parameters. The ECU calculates an injection amount of fuel to be injected, by correcting the desired fuel amount, based upon the first and second fuel amounts. When the engine is in a predetermined operating condition in which convergence of the fuel injection amount calculated by the ECU to the desired fuel amount can be unstable, the value of at least one of the parameters such that the fuel injection amount stably converges to the desired fuel amount.

14 Claims, 12 Drawing Sheets

ALMTL0 CALCULATION
S510
STARTING MODE IN LAST LOOP?
YES
NO
S550
F/C IN LAST LOOP ?
NO
YES
S560
ΔTH≦ΔTHGA ?
NO
YES
S570
KALMT← KALMTFC
S580
WITHIN STABLE REGION?
NO
YES
S590
NITDC2≧NTDC2 ?
NO
YES
S600
NITDC2← NITDC2+1
S520
KALMT← KALMTAST
KALMT← KALMTAB
S650
NITDC2←0
S610
S620
ALMTL0← ALMTL0−ΔALMT
S630
ALMTL0≦ALMTL ?
NO
YES
S640
ALMTL0←ALMTL
S530
ALMTL0← (1−A)×KALMT+A
S540
NITDC2←0
END

FUEL INJECTION AMOUNT CONTROL SYSTEM FOR INTERNAL COMBUSTION ENGINES

BACKGROUND OF THE INVENTION

1. Field of the Invention

This invention relates to a fuel injection amount control system for internal combustion engines, for controlling a fuel injection amount to be supplied to the engine.

2. Prior Art

Conventionally, a fuel injection amount control system for internal combustion engines is known, wherein a physical model is constructed which contemplates a behavior of fuel adhering to the wall surface of the intake pipe when fuel injected into the intake pipe is drawn into the cylinder of the engine, to thereby compensate for transfer delay of fuel adhering to the intake pipe.

According to the known system, provided that the amount of fuel to be injected is represented by TOUT, a desired amount of fuel to be drawn into the cylinder (required fuel amount) by Tcyl, the ratio of a fuel amount to be directly drawn into the cylinder to the whole amount of injected fuel, i.e. the direct supply ratio by A, an amount of fuel adhering to the intake pipe wall surface by Fw, the ratio of a fuel amount drawn into the cylinder by evaporation to the whole amount Fw of the adhering fuel by B, respectively, an amount of fuel adhering to the intake pipe out of the whole amount of injected fuel TOUT is expressed as (1−A)× TOUT, and an amount of fuel actually drawn into the cylinder as (A×TOUT+B×Fw). The fuel amount (A×TOUT+B×FW) corresponds to the desired fuel amount Tcyl to be drawn into the cylinder, and therefore the fuel injection amount to be injected can be calculated by the use of the following equation (1):

$$TOUT=1/A\times TCYL-B/A\times Fw \quad (1)$$

where the desired fuel amount Tcyl to be drawn into the cylinder is determined by parameters indicative of operating conditions of the engine, such as engine rotational speed NE and intake pipe absolute pressure PBA. The direct supply ratio A and the evaporation ratio B are retrieved from maps, based on load on the engine and engine coolant temperature Tw.

However, the above-mentioned conventional fuel injection amount control system has the following inconvenience, and therefore still requires further improvement. More specifically, the direct supply ratio A and the evaporation ratio B, which are parameters indicative of the fuel transfer delay representing fuel adherence characteristics of the interior of the intake pipe, are functions of operating parameters of the engine, which mainly represent dynamic characteristics of fuel exhibited when the engine is in a steady operating condition (i.e. when the NE and PBA values are constant), and moreover, these parameters numerically represent only dynamic characteristics of fuel exhibited when the fuel injection amount changes in a continuous manner.

Therefore, when the engine is operating in a transient state where the fuel injection amount is discontinuous, such as at the start of the engine, immediately after the start of the engine, and immediately after recovery from interruption of fuel supply (fuel cut), and a state where the operating condition of the engine largely changes, the fuel injection amount calculated based upon the parameters for the steady operating condition cannot be stably converged to the required fuel amount Tcyl or can even diverge from the latter, so that the air-fuel ratio A/F of a mixture supplied to the engine largely deviates from a desired value. As a result, the engine suffers from degraded drivability and degraded exhaust emission characteristics.

SUMMARY OF THE INVENTION

It is the object of the invention to provide a fuel injection amount control system for internal combustion engines, which is capable of supplying a stable fuel injection amount even when the engine is in an operating region where the fuel injection amount characteristic is discontinuous or the operating condition of the engine largely changes, such as immediately after the start of the engine or immediately after recovery from interruption of fuel supply, by calculating the fuel injection amount based on parameters indicative of the fuel transfer delay representing fuel adherence characteristics of the interior of the intake pipe.

To attain the above object, the present invention provides a fuel injection amount control system for an internal combustion engine having an intake passage having a wall surface, at least one combustion chamber, and fuel injection means for injecting fuel into the intake passage, including:

desired fuel amount-calculating means for calculating a desired amount of fuel to be supplied to each of the at least one combustion chamber in response to operating conditions of the engine;

parameter-calculating means for calculating values of parameters indicative of fuel adherence characteristics of an interior of the intake passage in response to operating conditions of the engine;

fuel amount-calculating means for calculating a first amount of fuel which is directly drawn into the each of the at least one combustion chamber from an amount of fuel injected by the fuel injection means, and a second amount of fuel which is carried off the wall surface of the intake passage due to evaporation and into each of the at least one combustion chamber from fuel adhering to the wall surface of the intake passage, based upon the values of the parameters indicative of the fuel adherence characteristics; and fuel injection amount-calculating means for calculating an injection amount of fuel to be injected by the fuel injection means, by correcting the desired fuel amount, based upon the first and second amounts of fuel.

The fuel injection amount control system according to the invention is characterized by comprising:

operating condition-detecting means for detecting whether the engine is in a predetermined operating condition in which convergence of the fuel injection amount calculated by the fuel injection amount-calculating means to the desired fuel amount can be unstable; and parameter-correcting means for correcting the value of at least one of the parameters indicative of the fuel adherence characteristics in a manner such that the fuel injection amount stably converges to the desired fuel amount, when the engine is in the predetermined operating condition.

Preferably, the predetermined operating condition of the engine includes a transient condition of the engine.

Specifically, the predetermined operating condition of the engine includes an operating condition of the engine immediately after the start of the engine, and an operating condition of the engine immediately after recovery from interruption of fuel supply.

In a preferred embodiment of the invention, the parameters indicative of the fuel adherence characteristics include a first parameter related to an amount of fuel injected by the fuel injection means and directly drawn into the each of the at least one combustion chamber. The parameter-correcting means corrects a value of the first parameter in a direction of increasing the value of the first parameter, when the engine is in the predetermined operating condition.

Preferably, the parameters indicative of the fuel adherence characteristics further include a second parameter related to a time delay with which an amount of fuel adhering to the wall surface of the intake passage after being injected by the fuel injection means, is drawn into the each of the at least one combustion chamber by evaporation. The parameter-correcting means may correct a value of the second parameter in a direction of decreasing the value of the second parameter, when the engine is in the predetermined operating condition.

In another embodiment of the invention, the parameters indicative of the fuel adherence characteristics include a first parameter related to an amount of fuel injected by the fuel injection means and directly drawn into the each of the at least one combustion chamber, and a third parameter related to an amount of fuel adhering to the wall surface of the intake passage after being injected by the fuel injection means and and thereafter drawn into the each of the at least one combustion chamber by evaporation. The parameter-correcting means corrects a value of the first parameter in a direction of increasing the value of the first parameter, and/or a value of the third parameter in a direction of decreasing the value of the third parameter, when the engine is in the predetermined operating condition.

In a preferred embodiment of the invention, the operating condition-detecting means determines whether the engine is in the predetermined operating condition, based on a combination of the values of the first and second parameters or based on a combination of the values of the first and third parameters.

More specifically, the predetermined operating condition of the engine is an operating region of the engine in which the following inequalities (1)–(3) are satisfied:

(1) $0<A<1.0$ (2) $0<1/T<1.0$ (3) $A>\frac{1}{2}\times 1/T$ where:

A=the first parameter;

1/T=the second parameter.

Alternatively, the predetermined operating condition of the engine is an operating region of the engine in which the following inequalities (1)–(3) are satisfied:

(1) $0<A<1.0$ (2) $0<B<1.0$ (3) $\frac{1}{2}B<A$ where:

A=the first parameter;

B=the third parameter.

Further, to attain the above object, the present invention also provides a fuel injection amount control system for an internal combustion engine having an intake passage having a wall surface, at least one combustion chamber, and fuel injection means for injecting fuel into the intake passage, including:

desired fuel amount-calculating means for calculating a desired amount of fuel to be supplied to each of the at least one combustion chamber in response to operating conditions of the engine; and fuel injection amount-calculating means for calculating an injection amount of fuel to be injected by the fuel injection means, by correcting the desired fuel amount such that a sum of a first amount of fuel directly drawn into the each of the at least one combustion chamber and a second amount of fuel which is carried off the wall surface of the intake passage due to evaporation and into the each of the at least one combustion chamber from fuel adhering to the wall surface of the intake passage is equal to said desired fuel amount.

This fuel injection control system is characterized by comprising:

operating condition-detecting means for detecting whether the engine is in a predetermined operating condition in which convergence of the fuel injection amount calculated by the fuel injection amount-calculating means to the desired fuel amount can be unstable; and suppressing means for suppressing correction of the desired fuel amount in a manner such that the fuel injection amount stably converges to the desired fuel amount, when the engine is in the predetermined operating condition.

Preferably, the suppressing means comprises:

parameter-calculating means for calculating values of parameters indicative of fuel adherence characteristics of an interior of the intake passage in response to operating conditions of the engine; and parameter-correcting means for correcting a value of at least one of the parameters indicative of the fuel adherence characteristics, when the engine is in the predetermined operating condition.

The above and other objects, features, and advantages of the invention will be more apparent from the following detailed description taken in conjunction with the accompanying drawings.

DETAILED DESCRIPTION OF THE DRAWINGS

The invention will now be described in detail with reference to the drawings showing embodiments thereof.

Figure 1:
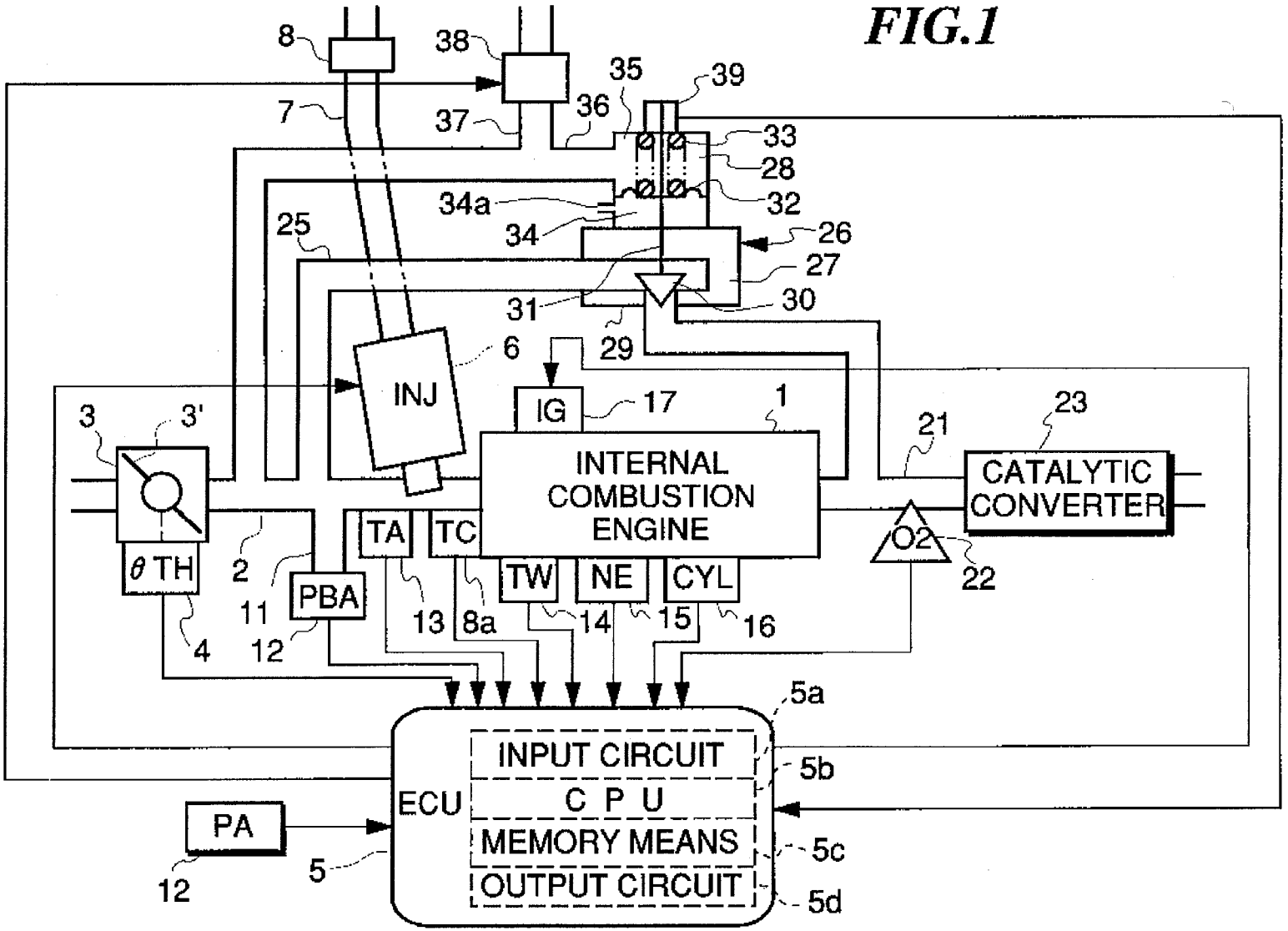
FIG. 1 is a schematic diagram showing the whole arrangement of an internal combustion engine and a fuel injection amount control system therefor, according to an embodiment of the invention.

Referring first to FIG. 1, there is illustrated the whole arrangement of an internal combustion engine and a fuel injection amount control system therefor, according to an embodiment of the invention. In the figure, reference numeral 1 designates an internal combustion engine (hereinafter referred to as "the engine") having, e.g. four cylinders. In an intake pipe 2 of the engine 1, there is arranged a throttle valve 3, to which is connected a throttle valve opening (θTH) sensor 4 for sensing the valve opening and supplying an electric signal indicative of the sensed throttle valve opening to an electronic control unit (hereinafter referred to as "the ECU") 5.

Fuel injection valves 6, only one of which is shown, are each provided for each cylinder and arranged in the intake pipe 2 between the engine 1 and the throttle valve 3 at a location slightly upstream of an intake valve, not shown. The fuel injection valves 6 are connected to a fuel pump, not shown, and electrically connected to the ECU 5 to have their fuel injection periods (valve opening periods) controlled by signals therefrom.

On the other hand, an intake pipe absolute pressure (PBA) sensor 12 is provided in communication with the interior of the intake pipe 2 at a location immediately downstream of the throttle valve 3, for sensing absolute pressure (PBA) within the intake pipe 2, and is electrically connected to the ECU 5 for supplying an electric signal indicative of the sensed absolute pressure PBA to the ECU 5. Further, an intake air temperature (TA) sensor 13 is mounted in the wall of the intake pipe at a location downstream of the PBA sensor 7, for supplying an electric signal indicative of the sensed intake air temperature TA to the ECU 5.

An engine coolant temperature (TW) sensor 14, which may be formed of a thermistor or the like, is mounted in a coolant-filled cylinder block of the engine, for supplying an electric signal indicative of the sensed engine coolant temperature TW to the ECU 5. An engine rotational speed (NE) sensor 15 and a cylinder discriminating signal (CYL) sensor 16 are arranged in facing relation to a camshaft or a crankshaft of the engine 1, neither of which is shown. The NE sensor 15 generates a pulse as a TDC signal pulse at each of predetermined crank angles whenever the crankshaft rotates through 180 degrees, while the CYL sensor 16 generates a pulse as a CYL signal pulse at a predetermined crank angle of a particular cylinder of the engine, both of the pulses being supplied to the ECU 5.

A catalytic converter (three-way catalyst) 23 is arranged in an exhaust pipe 21 extending from the cylinder block of the engine 1, for purifying noxious components present in the exhaust gases, such as HC, CO, and NOx. Further, an oxygen concentration sensor (hereinafter referred to as "the O2 sensor") 22 is arranged as an air-fuel ratio sensor in the exhaust pipe 21 at a location upstream of the catalytic converter 23, for supplying an electric signal indicative of the sensed oxygen concentration in exhaust gases to the ECU 5.

Further connected to the ECU 5 are an atmospheric pressure sensor 12*a* for detecting atmospheric pressure PA, and a wall temperature (TC) sensor 8*a*, which is embedded in a wall port of the intake pipe 2 in the vicinity of an intake port, not shown, of the intake pipe 2 and detects a wall temperature TC of the intake pipe 2, of which output signals indicative of the sensed values are supplied to the ECU 5. The wall temperature TC may be estimated from the intake pipe absolute pressure PBA and the engine rotational speed NE.

Next, an exhaust gas recirculation system will be described hereinbelow.

An exhaust recirculation passage 25 extends between the intake pipe 2 and the exhaust pipe 21, in a fashion bypassing the engine 1, with one end thereof connected to the exhaust pipe 21 at a location upstream of the O2 sensor 22 and the other end thereof connected to the intake pipe 2. Arranged across the exhaust gas recirculation passage 25 is an exhaust gas recirculation control valve (hereinafter referred to as "the EGR valve") 26 which is comprised of a casing 29 formed of a valve chamber 27 and a diaphragm chamber 28, a wedge-shaped valve element 30 which is arranged within the valve chamber 27 and disposed to move vertically such that the exhaust gas recirculation passage 25 is opened and closed by the valve element 30, a diaphragm 32 connected to the valve element 20 via a valve stem 31, and a spring 33 disposed to bias the diaphragm 32 in the valve closing direction. The diaphragm chamber 28 has its interior divided into a atmospheric pressure chamber 34 and a negative pressure chamber 35 defined by the diaphragm 32 on lower and upper sides thereof, respectively.

The atmospheric pressure chamber 34 communicates with the atmosphere via a vent hole 34*a*, while the negative pressure chamber 35 communicates with a negative pressure communication passage 36, which is connected to the intake pipe 2 so that the intake pipe absolute pressure (negative pressure) PBA is introduced via the negative pressure communication passage 36 into the negative pressure chamber 35. Further, an atmospheric pressure communication passage 37 is connected to the negative pressure communication passage 36, across which is arranged a pressure-adjusting valve 38. The pressure-adjusting valve 38 is formed by a normally closed electromagnetic valve, for selectively causing atmospheric pressure or negative pressure to be supplied into the negative pressure chamber 35 of the diaphragm chamber 28 such that predetermined control pressure is developed within the negative pressure chamber 35.

Further, the EGR valve 26 is provided with a valve lift sensor 39 for detecting the operating position (valve lift) of the valve element 30 of the EGR valve 26, of which an output signal indicative of the sensed valve lift is supplied to the ECU 5. The EGR control by the above exhaust gas recirculation system is carried out after warming-up of the engine has been completed (e.g. when the engine coolant temperature TW is higher than a predetermined value).

The ECU 5 is comprised of an input circuit 5a having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5b, memory means 5c storing various operational programs which are executed by the CPU 5b and for storing results of calculations therefrom, etc., and an output circuit 5d which outputs driving signals to the fuel injection valves 6.

The CPU 5b operates in response to the above-mentioned signals from the sensors to determine operating conditions in which the engine 1 is operating, such as an air-fuel ratio feedback control region in which air-fuel ratio feedback control is carried out in response to oxygen concentration in exhaust gases, and open-loop control regions, and calculates, based upon the determined engine operating conditions, a valve opening period or a fuel injection period Tout over which the fuel injection valves 6 are to be opened in synchronism with generation of TDC signal pulses.

The CPU 5b outputs driving signals for driving the fuel injection valves 6 responsive to the calculation results stated above, via the output circuit 5d.

[Conception of correction of fuel transfer delay]

Description will be made of correction of fuel transfer delay hereinbelow.

First, the principle of the correction of fuel transfer delay will be described with reference to FIGS. 2 to 6.

Figure 2:
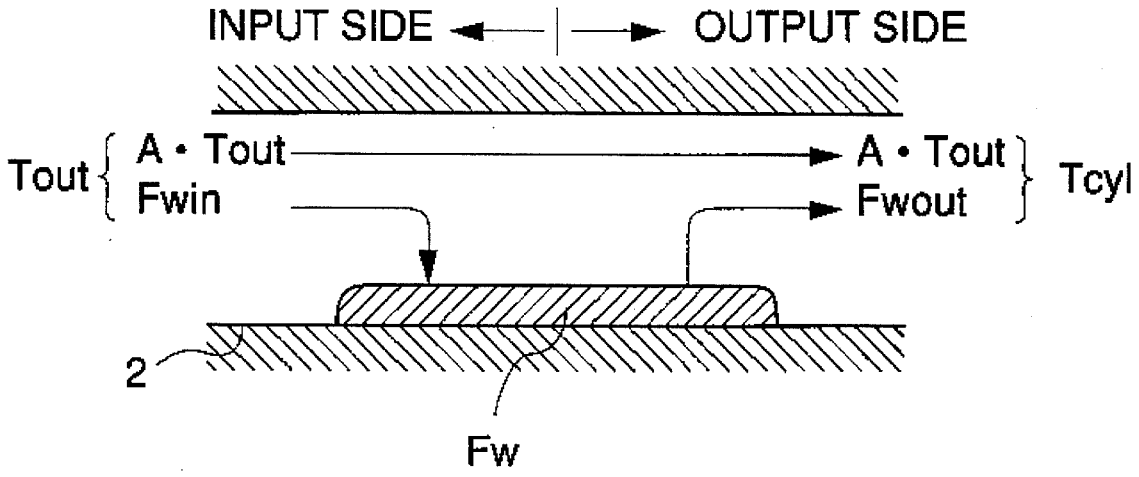
FIG. 2 is a schematic diagram showing the relationship between a fuel injection amount TOUT and a required fuel amount Tcyl.

FIG. 2 shows the relationship between the fuel injection amount Tout and a required fuel amount Tcyl.

In the figure, Tout represents a fuel injection amount injected from the fuel injection valve 6 into the intake pipe 2 in an operating cycle of the engine. Out of the injected fuel injection amount Tout, an amount equal to A×Tout (A: direct supply ratio) is directly supplied to the cylinder without adhering to the wall surface of the intake port, and the remaining amount of the injected fuel is added to an amount Fw of fuel which adhered to the wall surface up to the last operating cycle of the engine, as a new additional amount Fwin of adherent fuel. The direct supply ratio A is the ratio of a fuel amount directly drawn into a combustion chamber in an operating cycle of the engine to the whole fuel amount injected in the same operating cycle, and set in the relationship of $0<A<1$.

The sum of the above-mentioned product (A×Tout) and an amount Fwout of adherent fuel which is carried off the amount Fw of fuel adhering to the wall surface is set as the required fuel amount Tcyl.

Next, a first method of correcting the fuel transfer delay will be described.

The first method is based upon the concept that the carried-off amount Fwout is carried off with a predetermined time delay relative to supply of the additional amount Fwin. This concept is expressed as a first-order delay model, wherein the delay degree of the carried-off amount Fwout is represented by a delay coefficient (time constant) T.

As described hereinabove, the required fuel amount Tcyl is expressed by the following equation (1):

$$Tcyl=A\times Tout+Fwout \quad (1)$$

Therefore, the fuel injection amount Tout and the additional amount Fwin can be expressed by the following equations (2) and (3), respectively:

$$Tout=(Tcyl-Fwout)/A \quad (2)$$

$$Fwin=(1-A)\times Tout \quad (3)$$

Since the carried-off amount Fwout is equal to the first-order delay model of the additional amount Fwin, a value of the carried-off amount Fwout in the present loop can be expressed by the following equation (4):

$$Fwout(n)=Fwout\ (n-1)+(Fwin-Fwout)/T \quad (4)$$

According to the equation (4), the value of the carried-off amount Fwout(n) in the present loop is larger than the last value Fwout(n−1) thereof, by a value 1/T times as large as the difference between the additional amount Fwin and the carried-off amount Fwout. In short, whenever the calculation according to the equation (4) is carried out every operating cycle of the engine, the carried-off amount Fwout becomes closer to the additional amount Fwin by 1/T times as large as the difference.

Figure 3:
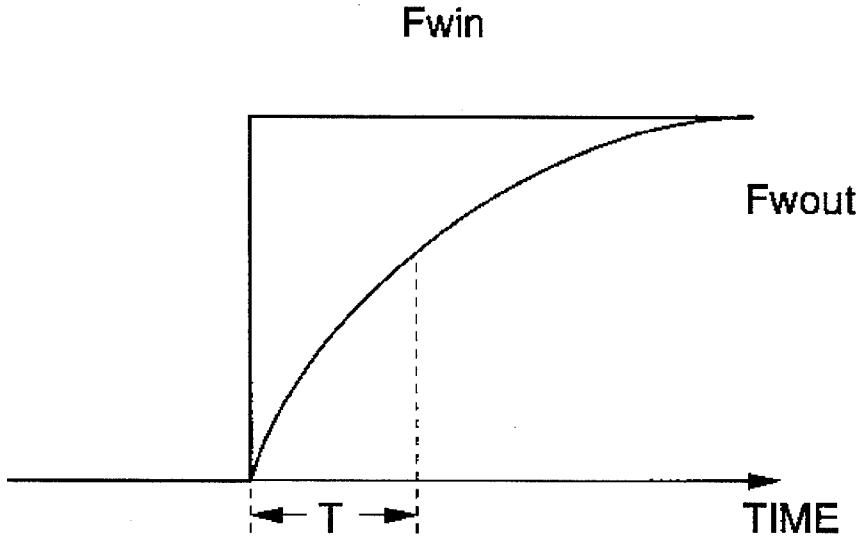
FIG. 3 is a graph showing a change in a new additional amount Fwin of adherent fuel and a change in a carried-off amount Fwout of adherent fuel with the lapse of time.

For example, if the fuel injection amount Tout is stepwise increased, the additional amount Fwin also stepwise increases as shown in FIG. 3 provided that the direct supply ratio A remains constant. On the other hand, the carried-off amount Fwout progressively increases to the additional amount Fwin, at a rate based on the time constant T. The time constant T represents a time period required for the carried-off amount Fwout to reach 63.2% of the whole carried-off amount after the carried-off amount Fwout starts to increase. The T value is determined based on operation conditions of the engine, as described hereinbelow.

Thus, the fuel injection amount Tout can be calculated by the use of the equations (2), (3) and (4).

Figure 4:
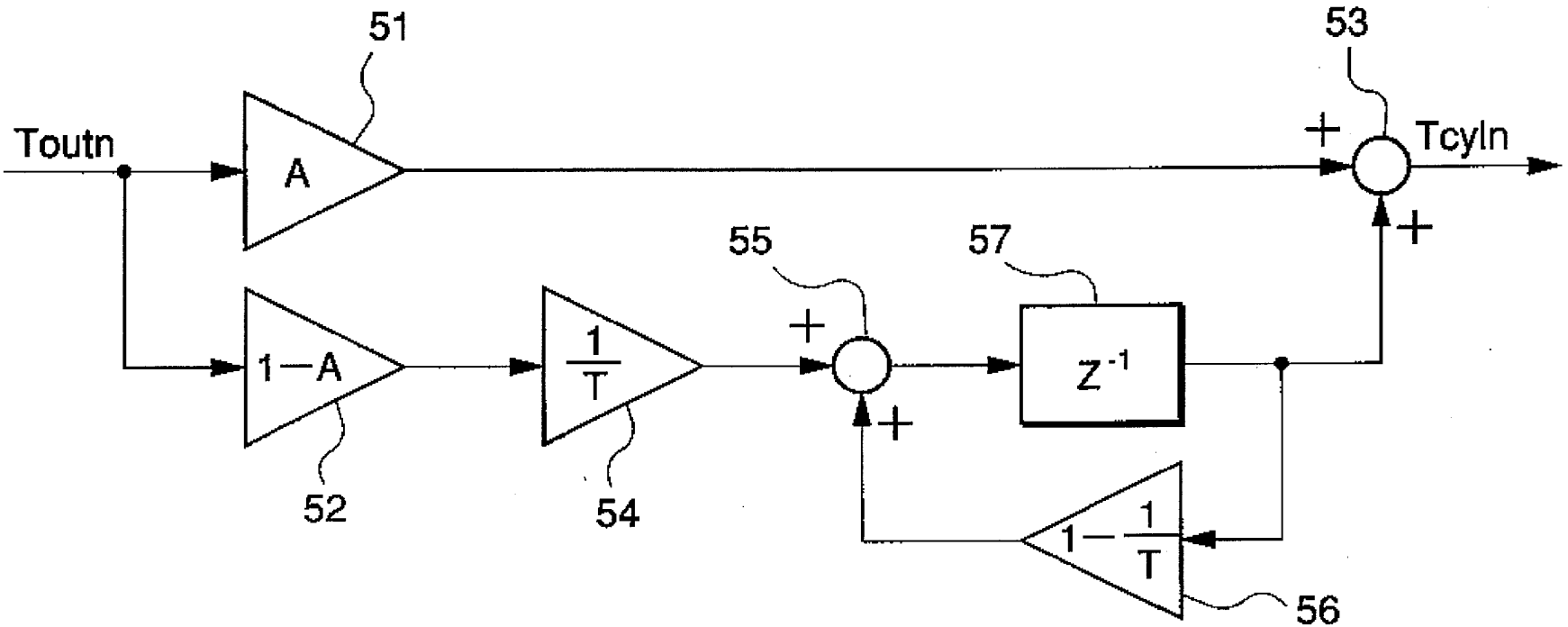
FIG. 4 is a schematic diagram showing a physical model circuit modeled on fuel transfer delay correction according to an A-T method.

FIG. 4 schematically shows a physical model circuit modeled on the fuel transfer delay correction according to the first method (hereinafter referred to as "the A-T method").

In the figure, a fuel injection amount Tout(n) injected from the fuel injection valve 6 in one operating cycle (n) of the engine is multiplied by the value A (direct supply ratio) at a multiplier 51, while it is multiplied by the (1−A) value at a multiplier 52. An output from the multiplier 51, i.e. a value (An×Toutn) is supplied to an adder 53, where the carried-off amount Fwout(n) in the present loop is added to the (An×Toutn) value, into the required fuel amount Tcyl(n) to be applied in the present loop.

On the other hand, an output from the multiplier 52, i.e. the additional amount Fwin(n) in the present loop, which is the amount Fwin(n)=(1−An)×Tout(n) obtained by the equation (7). The Fwin(n) value is multiplied by 1/T at a multiplier 54, which supplies the resulting output to an adder 55, wherein an output from a multiplier 56 is added to the output from the multiplier 54. The output from the multiplier 56 is the product of a value (1−1/Tn) and the carried-off amount Fwout(n) from the adder 53.

The carried-off amount Fwout(n) supplied to the adder 53 is an output from a cycle delay circuit 57 which delays an input thereto by one cycle (1 TDC), and therefore an input supplied to the cycle delay circuit 57 becomes a carried-off amount Fwout(n+1) to be applied in the next cycle.

Therefore, the output from the adder 55, i.e. the carried-off amount Fwout(n+1) supplied to the cycle delay circuit 57 is expressed by the following equation (5):

$$Fwout(n+1)=Fwin(n)/T+(1-1/Tn)\times Fwout(n)=Fwout(n)+(Fwin(n)-Fwout(n))/T \quad (5)$$

where Fwin(n)=(1−An)×Tout(n).

This equation (5) corresponds to the equation (4).

Next, a second method of correcting the fuel transfer delay will be described.

The second method is disclosed by Japanese Provisional Patent Publication (Kokai) No. 1-305142, wherein in addition to the direct supply ratio A, a carry-off ratio B (0<B<1) is employed for correcting the fuel transfer delay. The carry-off ratio B represents the ratio of an amount of fuel which is carried off the inner wall of the intake port and into the combustion chamber of the engine by evaporation, etc. in the present operating cycle to the amount of fuel which adhered to the wall surface of the intake port up to the immediately preceding cycle. In the second method, similarly to the first method, the value A×Tout is employed, which is an amount directly supplied to the cylinder without adhering to the wall surface of the intake port, as well as the product ((1−A)×Tout), which is equal to the additional amount Fwin of adherent fuel, whereas the carried-off amount Fwout of adherent fuel is employed, which is a product B×FW out of the wall surface adherent fuel amount Fw at the start of the present cycle.

As shown in the equation (1), the required fuel amount Tcyl is determined as follows:

$$Tcyl=A\times Tout+Fwout \quad (1)$$

The carried-off amount Fwout and the additional amount Fwin can be expressed by the following equations (1-a) and (3):

$$Fwout=B\times Fw \quad (1\text{-a})$$

$$Fwin=(1-A)\times Tout \quad (3)$$

Therefore, an amount Fw(n) of fuel adhering to the wall surface in the present loop changes with respect to an adherent fuel amount Fn(n−1) calculated up to the immediately preceding loop by the difference between the additional amount Fwin and the carried-off amount Fwout. Thus, the adherent fuel amount Fw(n) in the present loop can be expressed by the following equation (6):

$$\begin{aligned} Fw(n) &= Fw(n-1)+Fwin-Fwout \\ &= Fw(n-1)+(1-A)\times Tout-B\times Fw(n-1) \\ &= (1-A)\times Tout+(1-B)\times Fw(n-1) \end{aligned} \quad (6)$$

Further, the fuel injection amount Tout can be expressed by the equation (7), by substituting the equation (1-a) into the equation (2) transformed from the above equation (1):

$$\begin{aligned} Tout &= (Tcyl-Fwout)/A \\ &= (Tcyl-B\times Fw)/A \end{aligned} \quad (7)$$

Thus, the fuel injection amount Tout can be calculated by the use of the equations (6) and (7).

Figure 5:
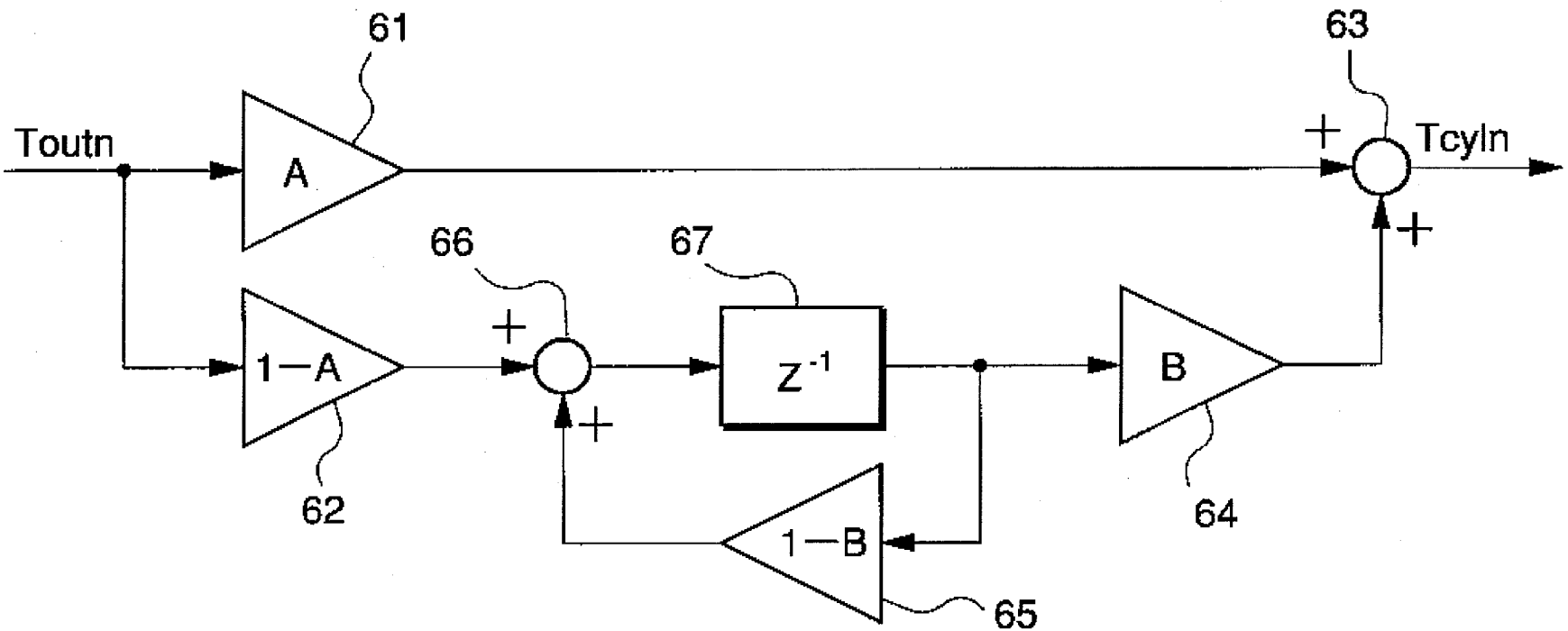
FIG. 5 is a schematic diagram showing a physical model circuit modeled on fuel transfer delay correction according to an A-B method.

FIG. 5 schematically shows a physical model circuit modeled on the fuel transfer delay correction according to the second method (hereinafter referred to as "the A-B method").

In the figure, a fuel injection amount Tout(n) injected from the fuel injection valve 6 in one operating cycle (n) of the engine is multiplied by the value A (direct supply ratio) at a multiplier 61, while it is multiplied by the (1−A) value at a multiplier 62. An output: from the multiplier 61, i.e. a value (A(n)×Tout(n)) in the present loop is supplied to an adder 63, where an output from a multiplier 64, i.e. a carried-off amount Fwout(n) in the present loop is added to the output from the adder 61, to thereby obtain the required fuel amount Tcyl(n) to be applied in the present loop.

As mentioned above, in the A-B method, the carried-off amount Fwout(n) in the present loop, i.e. the output from the multiplier (64), is equal to the B×Fw(n) value out of the amount Fw(n) adherent fuel to the wall surface at the start of the present loop, which has been accumulated up to the immediately preceding loop. The adherent fuel amount Fw(n) at the start of execution of the present loop is supplied to the multiplier 64. The adherent fuel amount Fw(n) is multiplied by the value (1−B) at a multiplier 65, and the resulting product (1−B)×Fw(n) is supplied to an adder 66.

On the other hand, an output from the multiplier 62 is equal to the additional amount Fwin, which is accordingly equal to the value obtained by the above equation (3): Fwin(n)=(1−A)×Tout(n). Further, this output is supplied to the adder 66, where the output is added to the output from the multiplier 65, i.e. the value (1−B)×Fw(n). The fuel adherent amount Fw(n) at the start of the present cycle, i.e. an input to each of the multipliers 64 and 65, is an output from a cycle delay circuit 67 which delays an input thereto by one cycle (1 TDC). Therefore, the input supplied to the cycle delay circuit 67 becomes a fuel adherent amount Fw(n+1) at the start of execution of the next loop, i.e. the amount of fuel adherent to the wall surface at the end of execution of the present loop.

In short, a fuel amount corresponding to a value (B×Fwout(n)) is carried off the fuel adherent amount Fw(n) at the start of execution of the present loop, i.e. the adherent fuel amount accumulated up to the immediately preceding loop, as the output from the multiplier 64. A fuel amount corresponding to a value (1−B)×Fwout(n) remaining adherent to the wall surface without being carried off is added to the additional amount Fwin(n) in the present loop, i.e. the output from the multiplier 62, by the adder 66.

Therefore, the adherent fuel amount Fw(n+1) in the next loop, i.e. the output from the adder 66, can be expressed by the following equation (8):

$$\begin{aligned} Fw(n+1) &= Fwin(n)+(1-B(n))\times Fw(n) \\ &= (1-A(n))\times Tout(n)+(1-B(n))\times Fw(n) \\ &= Fw(n)+(1-A(n))\times Tout(n)-B(n)\times Fw(n) \end{aligned} \quad (8)$$

This equation (8) corresponds to the above equation (5).

In the embodiment described hereinbelow, the A-T method is employed.

Figure 6:
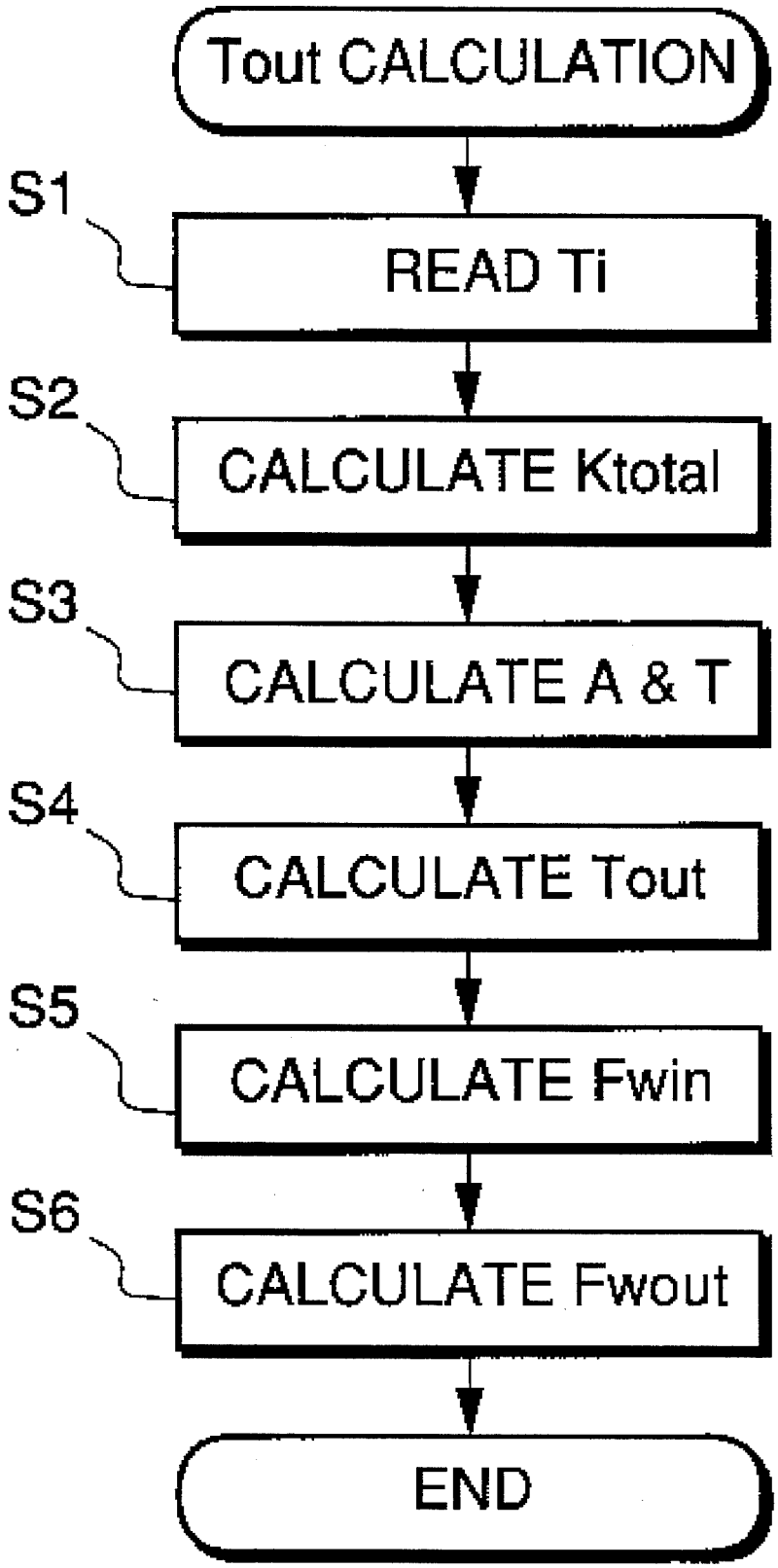
FIG. 6 is a flowchart showing a program for calculating a fuel injection amount.

FIG. 6 shows a program for calculating the fuel injection amount Tout. This routine is executed in synchronism with generation of each TDC signal pulse. First at a step S1, a basic value Ti of the fuel injection amount Tout is determined by retrieving a Ti map, based on the engine rotational speed NE and the intake pipe absolute pressure PBA. Then, at a step S2, a correction coefficient Ktotal is calculated by multiplying various correction coefficients, such as a correction coefficient KTW depending on the engine coolant temperature TW, a correction coefficient KAST applied immediately after the start of engine, a correction coefficient KWOT applied under a high load condition of the engine, a mixture-leaning coefficient KLS, a correction coefficient KTA depending on the intake air temperature, and an air-fuel ratio correction coefficient KO2 depending on an output from the O2 sensor 22. The required fuel amount Tcyl for the cylinder can be determined by multiplying the basic fuel injection amount Ti by the correction coefficient Ktotal.

At a step S3, the direct supply ratio A and the transfer delay time constant T are calculated. Then, the fuel injection amount Tout(n) is calculated at a step S4, by the use of the equations (2) and (4). As the carried-off amount Fwout(n−1) applied in the equation (4), a value calculated in the immediately preceding loop is used. Based on the calculated fuel injection amount Tout(n) to be applied in the present loop, the additional amount Fwin(n) and the carried-off amount Fwout(n) in the present loop are calculated by the use of the equations (3) and (4), at steps S5 and S6, respectively, which in turn will be used for calculating the fuel injection amount Tout in the next loop, followed by terminating the present routine.

[Determination of stable region of fuel injection amount]

Then, description will be made of a method of determining whether or not the engine is in an operating region where the fuel injection amount Tout calculated by the above described routine stably converges to the required fuel amount Tcyl, based on the A-T method.

Figure 7:
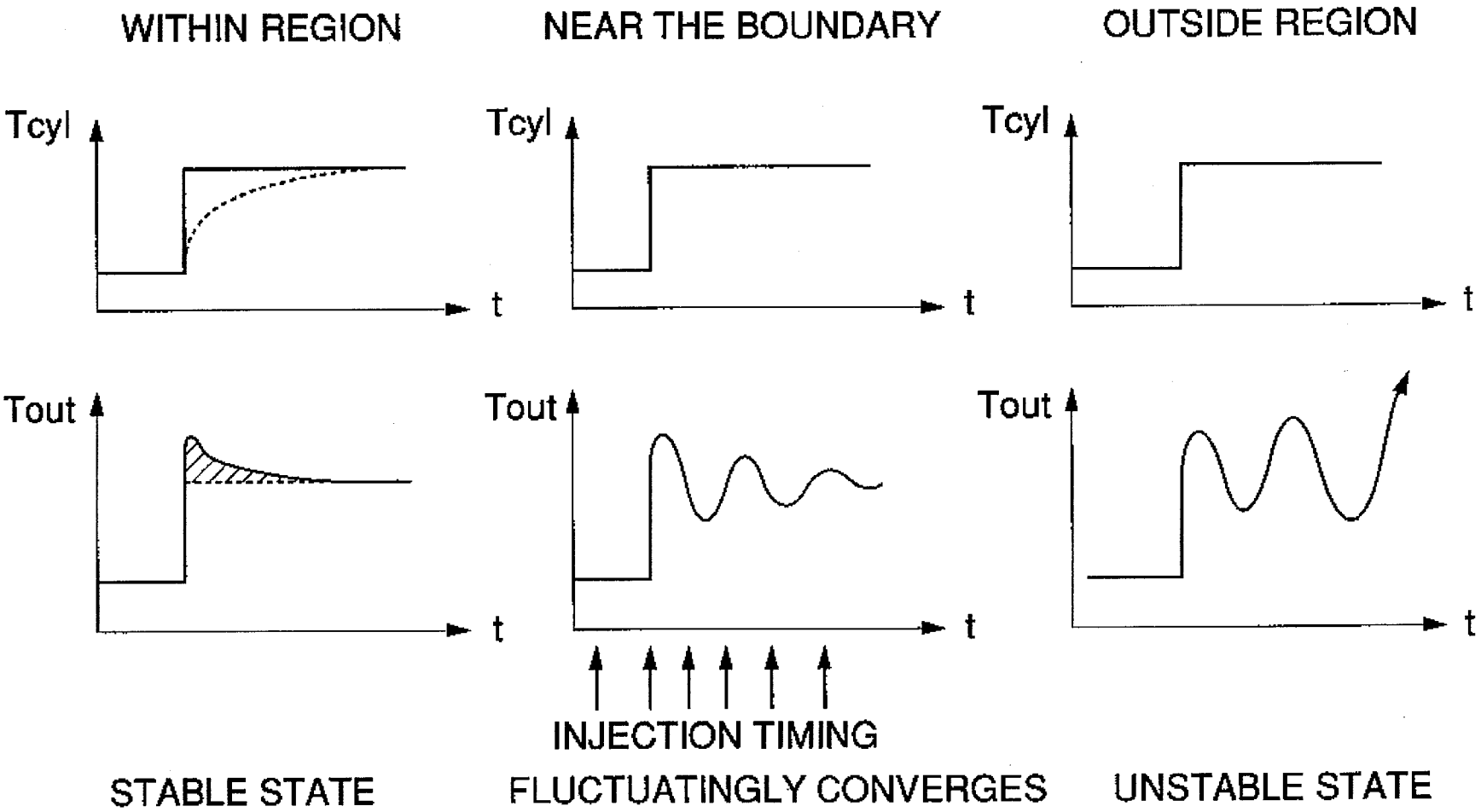
FIG. 7 is a schematic diagram useful in explaining states where the fuel injection amount TOUT calculated is steady and unsteady for the required fuel amount Tcyl.

FIG. 7 schematically shows a case where the calculated fuel injection amount Tout stably converges to the required fuel amount Tcyl, and a case where it unstably converges to the required fuel amount Tcyl.

When the fuel injection amount Tout after execution of transfer delay correction stably converges to the required fuel amount Tcyl, initially the Tout value slightly overshoots the Tcyl value as a result of execution of transfer delay correction when the Tcyl value has changed, however, the Tout value thereafter progressively approaches a constant value corresponding to the Tcyl value. The shaded portion shown in (1) of FIG. 7 indicates that the fuel injection amount slightly exceeds the required fuel amount because an amount corresponding to the amount of fuel adherent to the wall surface of the intake pipe 2 is included in the Tout value.

When the calculated fuel injection amount Tout does not stably converge to the required fuel amount Tcyl, the calculated Tout value fluctuates with respect to the required fuel amount Tcyl, as shown in (2) and (3) of FIG. 7. When the Tout value becomes more unstable, it diverges from the required fuel amount Tcyl, as shown in (3) of FIG. 7. Divergence of such an unstable fuel injection amount is liable to occur in a transient state of the engine, such as immediately after the start of the engine or immediately after recovery from interruption of fuel injection.

According to the present embodiment, to determine a region where the calculated fuel injection amount becomes stable, a transfer function G(S) of the fuel injection amount Tout for the required fuel amount Tcyl is introduced by the use of a fuel adherence characteristic parameter A×T. The transfer function determines conditions for stabilization of the fuel injection amount Tout, which is represented by the equation: G(S)=Tout/Tcyl.

First, the additional amount Fwin and the carried-off amount Fwout are eliminated from the aforesaid basic equations (2), (3) and (4), whereby the fuel injection amount Tout is expressed by the required fuel amount Tcyl, the direct supply ratio A and the transfer delay time constant T, by the following equation (9):

$$Tout(n)=\{1-(-1/T)\times Z^{-1}\}/\{A-(A-1/T)\times Z^{-1}\}\times Tcyl(n) \quad (9)$$

where $Z^{-1}$ represents a time lag of one operational cycle corresponding to a value ($Tout(n-1)=Z^{-1}\,Tout(n)$). Thus, the transfer function G(S) is represented by the following equation (10):

$$G(S)=\{1-(1-1/T)\times Z^{-1}\}/\{A-(A-1/T)\times Z^{-1}\} \quad (10)$$

It is known from the control theory that the condition for stabilization of the transfer function G(S) is that the root of Z in the equation of G(S) wherein the denominator is equal to zero, falls within a range of ±1, i.e. within a range of a unit circle.

Therefore, the conditions for stabilization of the fuel injection amount TOUT can be expressed by the following equation (11) and inequality (12):

$$A-(A-1/T)Z^{-1}=0 \quad (11)$$

$$-1<Z<1 \quad (12)$$

The equation (11) can be transformed into Z=(A−1 /T)/A. If this relationship is substituted into the equation (12), the relationship between the direct supply ratio A and the fuel transfer delay ratio 1/T can be expressed by the following inequalities (13):

$$\tfrac{1}{2}\times 1/T<A$$

$$0<1/T \quad (13)$$

Since the direct supply ratio A is the ratio of a fuel amount directly drawn into the combustion chamber to the whole injected fuel amount, it assumes a positive value of less than 1.0. Also, since the fuel transfer delay ratio 1/T represents a time delay with which fuel adhering to the wall surface of the intake pipe is drawn into the combustion chamber, it assumes a positive value of less than 1.0. Therefore, these parameters can be expressed by the following inequalities (14):

$$0<A<1.0$$

$$0<1/T<1.0 \quad (14)$$

From the above inequalities (13), (14), the following inequalities (15) represent conditions for stabilization of the fuel injection amount TOUT:

(1) $0<A<1.0$ (2) $0<1/T<1.0$ (3) $A>\tfrac{1}{2}\times 1/T$ (15)

Figure 8:
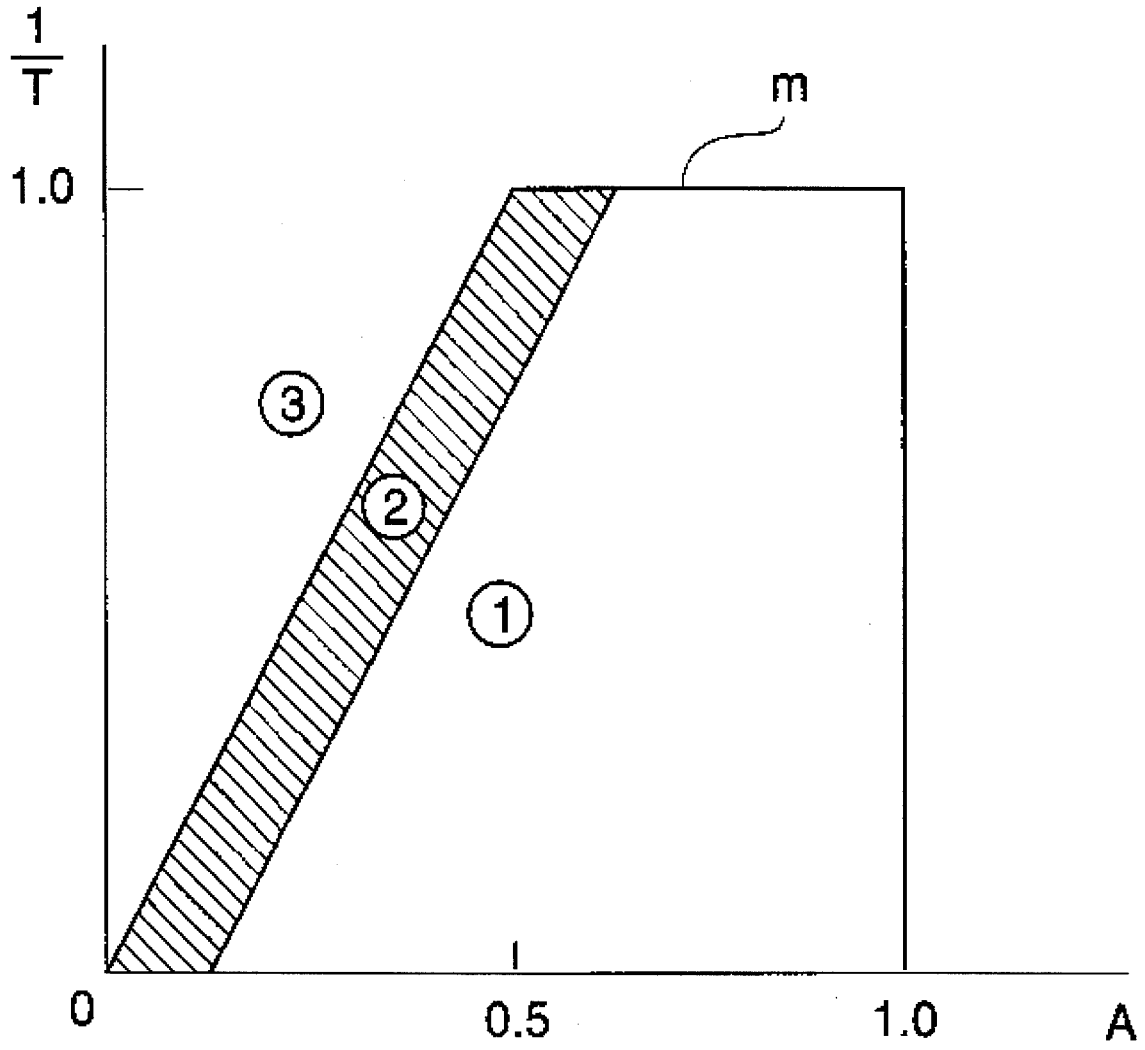
FIG. 8 is a graph showing a stable region of a transfer delay ratio 1/T and a direct supply ratio A.

FIG. 8 shows a region where the above conditions (1) to (3) are satisfied. In the figure, regions (1) and (2) enclosed by the solid line m satisfy the above conditions (1) to (3) and correspond to (1) of FIG. 7, in which the fuel injection amount can be stably calculated. However, the region (2) bordering on a region (3) corresponds to (2) of FIG. 7, in which the calculated fuel injection amount can converge to the required fuel amount Tcyl in a fluctuating manner. Therefore, this region (2) which is liable to fluctuate is excluded from the stable region for prevention of degradation of exhaust emission characteristics of the engine.

The region (3) in FIG. 8 is a region where the calculated fuel injection amount can unstably diverge from the required fuel amount Tcyl, resulting in degraded exhaust emission characteristics of the engine.

Next, a manner of determining conditions for stabilization of the fuel injection amount, based on the A-B method using the direct supply ratio A and the evaporation ratio B.

First, the additional adherent fuel amount Fwin and the carried-off fuel amount Fwout are eliminated from the aforementioned equations (3), (7) and (8), whereby the fuel injection amount TOUT can be expressed by the following equation (16):

$$TOUT(n)=\{1-(1-B)Z^{-1}\}/\{A-(A-B)Z^{-1}\}\times Tcyl(n) \quad (16)$$

where $z^{-1}$ represents one operational cycle time lag ($TOUT(n-1)=Z^{-1}TOUT(n)$), similarly to the A-T method described above. Therefore, the transfer function G(S) can be expressed by the following equation (17), similarly to the A-T method:

$$G(S)=\{1-(1-B)Z^{-1}\}/\{A-(A-B)Z^{-1}\} \quad (17)$$

Thus, the conditions for stabilization of the transfer function G(S) are similar to those of the above described A-T method. The evaporation ratio B is the ratio of a fuel amount which is carried off the intake pipe wall surface due to evaporation to the whole amount of fuel adhering to the intake pipe wall surface and hence assumes a positive value of less than 1.0. Therefore, the conditions for stabilization of the calculated fuel injection amount TOUT are expressed by the following inequalities (18):

$$0<A<1.0$$

$$0<B<1.0$$

$$\tfrac{1}{2}B<1.0 \quad (18)$$

[Calculation of direct supply ratio A]

Figure 9:
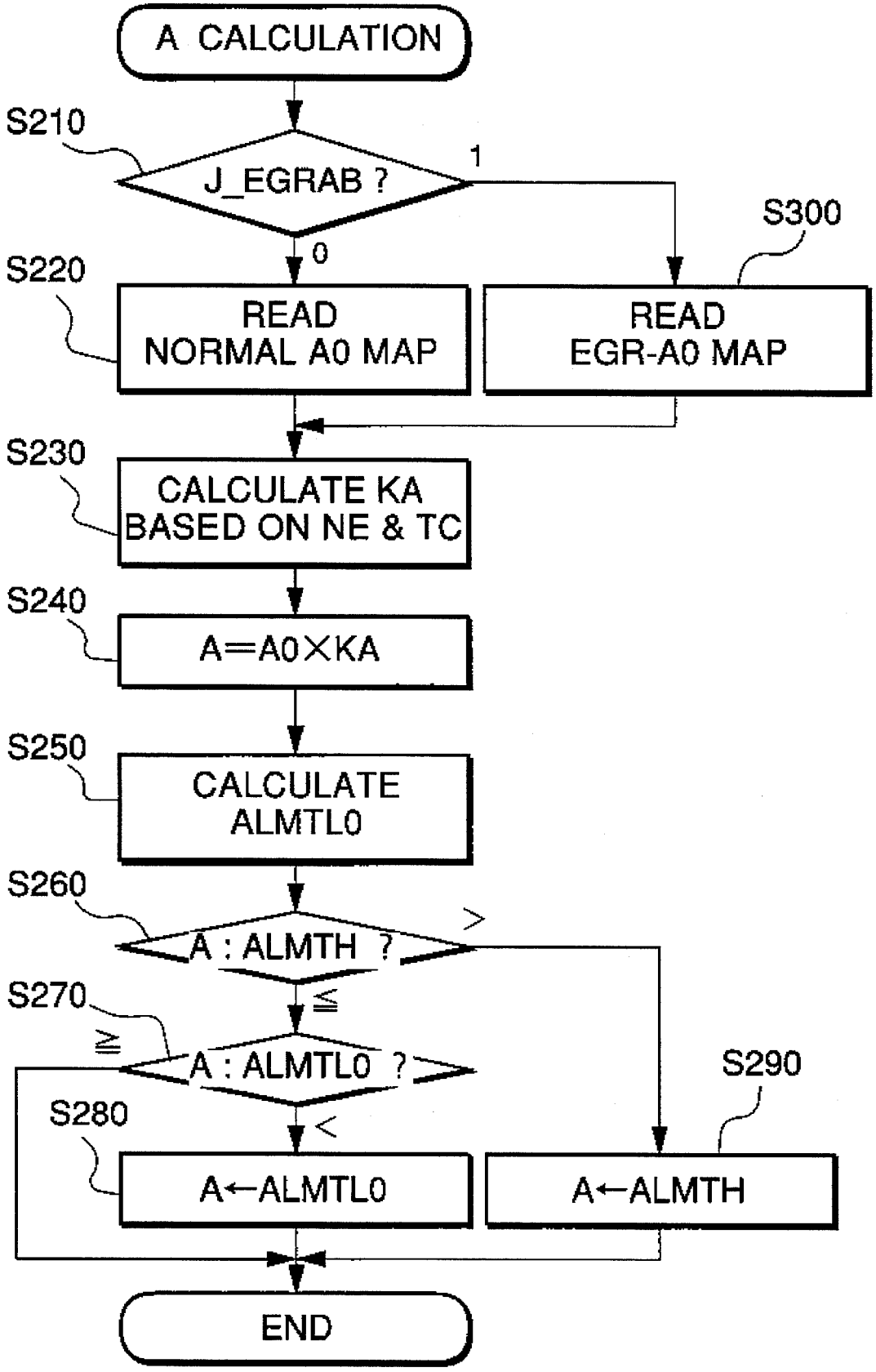
FIG. 9 is a flowchart showing a program for calculating the direct supply ratio A.

Next, a manner of calculation of the direct supply ratio A will be described with reference to FIG. 9 showing a routine for calculating the direct supply ratio A. This routine is executed in synchronism with generation of each TDC signal pulse.

First, it is determined at a step S210 whether or not exhaust gas recirculation is being carried out, from a flag JEGRAB, which is set to "1" when exhaust gas recirculation is to be carried out. If the flag JEGRAB assumes "0" and exhaust gas recirculation is not carried out, a basic value A0 of the direct-supply ratio A is determined from an A0 map for normal operation, according to the engine rotational speed NE and the intake pipe absolute pressure PBA, at a step S220. Then, a value of the wall temperature TC of the intake pipe 2 sensed by the wall temperature sensor 8*a* is read into the CPU 5*b*, and a correction value KA for the direct supply ratio A is determined from a KA map, based on the read wall wall temperature TC value and the engine rotational speed NE, at a step S230. The basic value A0 is multiplied by the calculated correction value KA to calculate the direct supply ratio A at a step S240. The reason why the wall temperature TC is used to calculate the direct supply ratio at the step S230 is that the amount of fuel adhering to the wall surface of the intake pipe 2 without being directly drawn into the combustion chamber out of the fuel amount injected into the intake pipe 2 depends upon the wall temperature TC, and hence the direct supply ratio A also depends upon the wall temperature TC.

Then, a lower limit value ALMTL0 of the direct supply ratio A is calculated by the use of the calculated direct supply ratio A, and a value of the fuel transfer delay ratio 1/T which is calculated by a fuel transfer delay time constant-calculating routine, hereinafter described, at a step S250, in order to avoid the fuel injection amount TOUT calculated by the fuel injection-calculating routine of FIG. 6 from falling within the regions (2) and (3) in FIG. 8. Details of the manner of calculating the lower limit value ALMTL0 at the step S250 will be described hereinafter.

Next, limit checking of the value of the direct supply ratio A calculated at the step S240 is carried out at steps S260 to S290. More specifically, it is determined whether or not the calculated value of the direct supply ratio A exceeds an upper limit value ALMTH (e.g. 0.9) at the step S260. If the former exceeds the latter, it is determined at the step S270 whether or not the calculated value of the direct supply ratio A is smaller than the lower limit value ALMTL0. If the calculated direct supply ratio A value is smaller than the lower limit value ALMTL0, the former is set to the latter at the step S280, followed by terminating the routine. If the direct supply ratio A value exceeds the lower limit value ALMTL0, the present routine is immediately terminated without correcting the direct supply ratio A value.

If the direct supply ratio A value exceeds the upper limit value ALMTH at the step S260, the former is set to the latter at the step S290, followed by terminating the routine.

If it is determined at the step S210 that the exhaust gas recirculation is being carried out with the flag JEGRAB being set to "1", the EGR map is changed to an A0 map for exhaust gas recirculation (EGR) and a basic value A) of the direct supply ratio is determined by the use of the A0 map at a step S300, similarly to the step S220, followed by execution of the steps S230 to S290.

[Calculation of fuel transfer delay time constant T]

Figure 10:
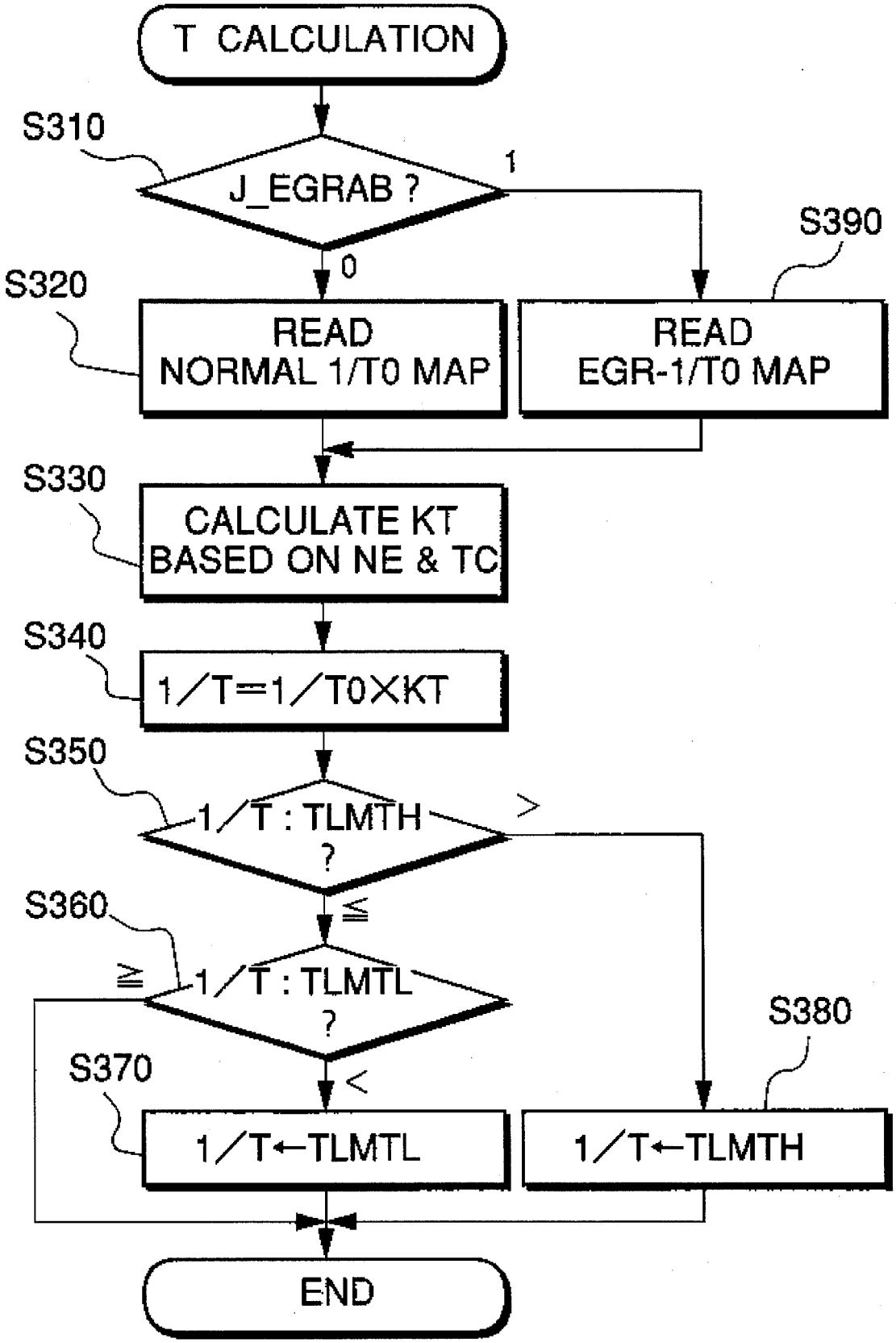
FIG. 10 is a flowchart showing a program for calculating a transfer delay time constant T.

Next, a manner of calculation of the fuel transfer delay time constant T which is used together with the direct supply ratio A in calculation of the fuel injection amount will be described with reference to FIG. 10 showing a routine for calculating the fuel transfer delay time constant T. This routine is executed in synchronism with generation of each TDC signal pulse. The reciprocal of the fuel transfer delay time constant T is the fuel transfer delay ratio 1/T. First, similarly to the calculation of the direct supply ratio A described above, it is determined at a step S310 whether the flag JEGRAB has been set to "1" or "0" to determine whether or not exhaust gas recirculation is being carried out. If the flag JEGRAB has been set to "0" and hence no exhaust gas recirculation is being carried out, a basic value 1/T0 of the fuel transfer delay ratio 1/T is determined from a 1/T0 map for normal operation, according to the engine rotational speed NE and the intake pipe absolute pressure PBA, at a step S320.

Then, a correction value KT for the fuel transfer delay ratio 1/T is determined from a KT map, according to the wall temperature TC and the engine rotational speed NE at a step S330, since, like the direct supply ratio A, the fuel transfer delay ratio 1/T also depends upon the wall temperature TC of the intake pipe 2. The basic value 1/T0 is multiplied by the calculated correction value KT to calculate a value of the fuel transfer delay ratio 1/T.

Then, limit checking of the calculated value of the fuel transfer delay ratio 1/T is carried out. First, it is determined whether or not the calculated value of the fuel transfer delay ratio 1/T exceeds an upper limit value TLMTH at a step S350. If the former exceeds the latter, it is determined at a step S360 whether or not the calculated 1/T value is smaller than a lower limit value TLMTL at a step S360. If the calculated 1/T value is smaller than the lower limit value TLMTL, the former is set to the latter at a step S370, followed by terminating the present routine. If the 1/T value exceeds the lower limit value TLMTL at the step S360, the routine is immediately terminated without correcting the 1/T value. If at the step S350 the 1/T value exceeds the upper limit value TLMTH, the fuel transfer delay ratio 1/T is set to the upper limit value TLMTH at a step S380, followed by terminating the routine.

If at the step S310 it is determined that the flag JEGRAB has been set to "1" to indicate that exhaust gas recirculation is being carried out, the 1/T0 map is changed to a 1/T0 may for EGR operation to determine a basic value 1/T0 from the 1/T0 map for EGR operation, at a step 390, and thereafter the above described steps S330 to S380 are executed.

[Calculation of lower limit value ALMTL0]

Figure 11:
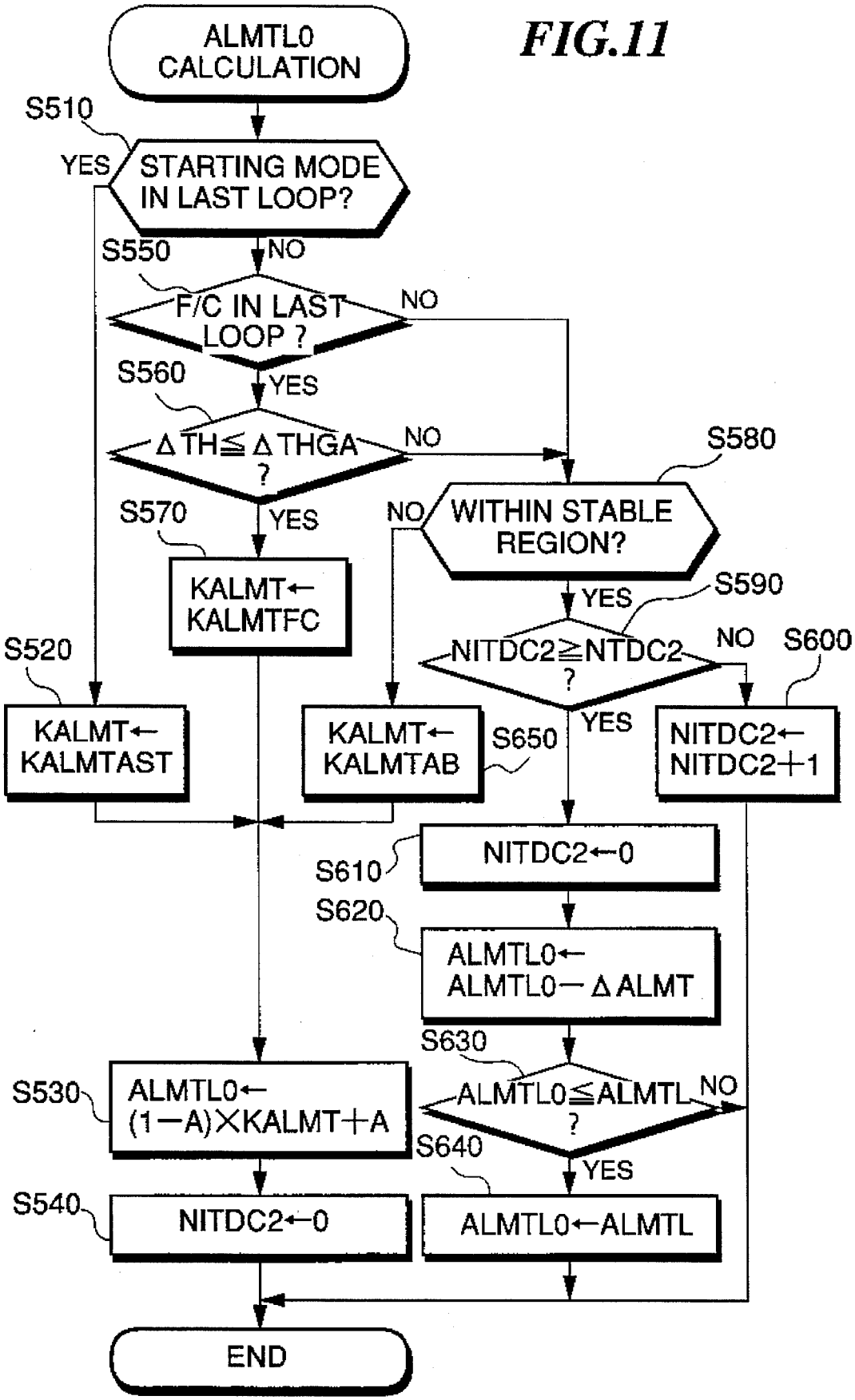
FIG. 11 is a flowchart showing a program for calculating a lower limit value ALMTL0.
Figure 12:
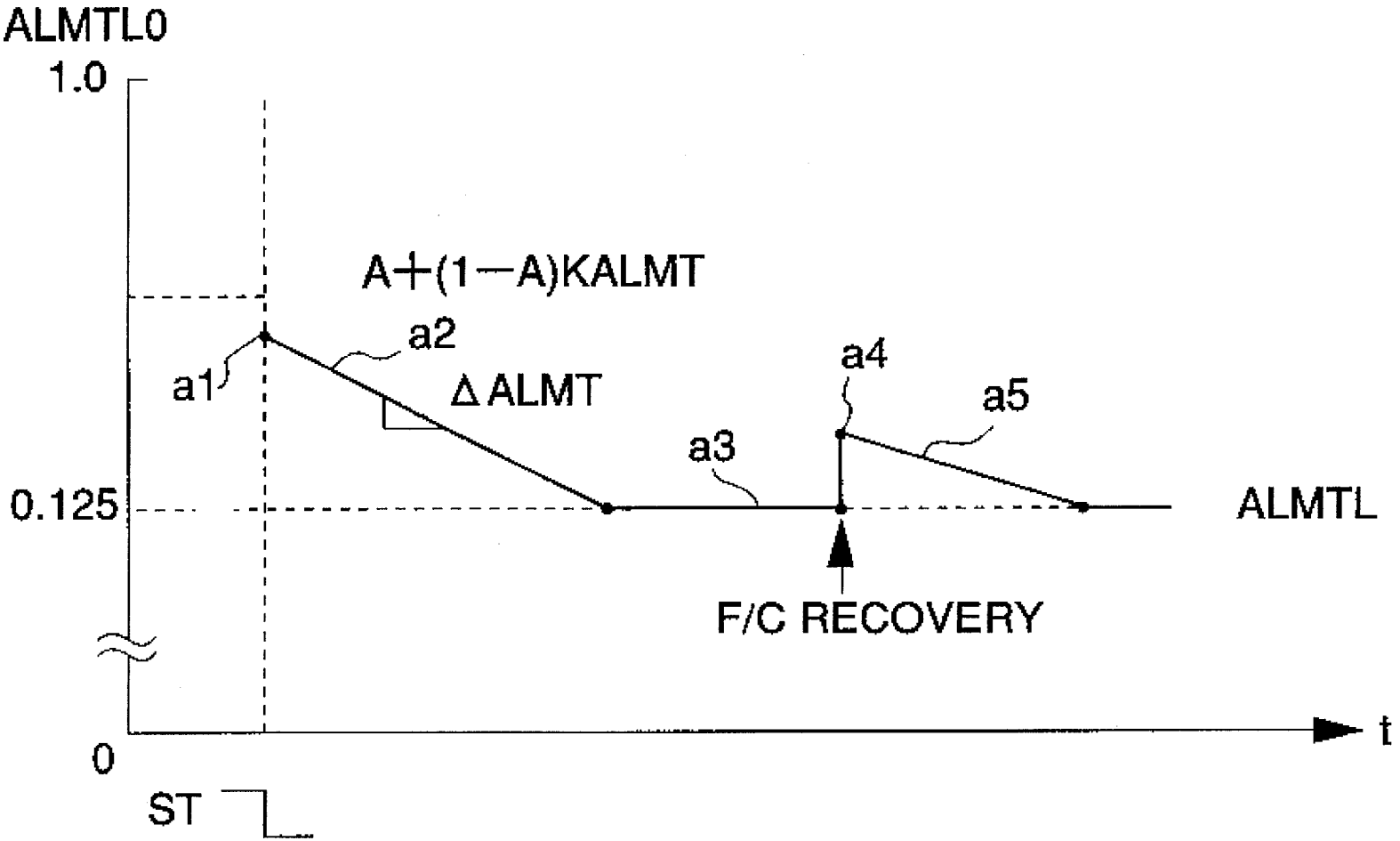
FIG. 12 is a timing chart showing a change in the lower limit value ALMTL0.

Now, a manner of calculating the lower limit value ALTMT0 will be described with reference to FIGS. 11 and 12. FIG. 11 shows a routine for calculating the lower limit value ALMTL0, and FIG. 12 shows an example of a change in the lower limit value ALMTL0 with the lapse of time.

Figure 13:
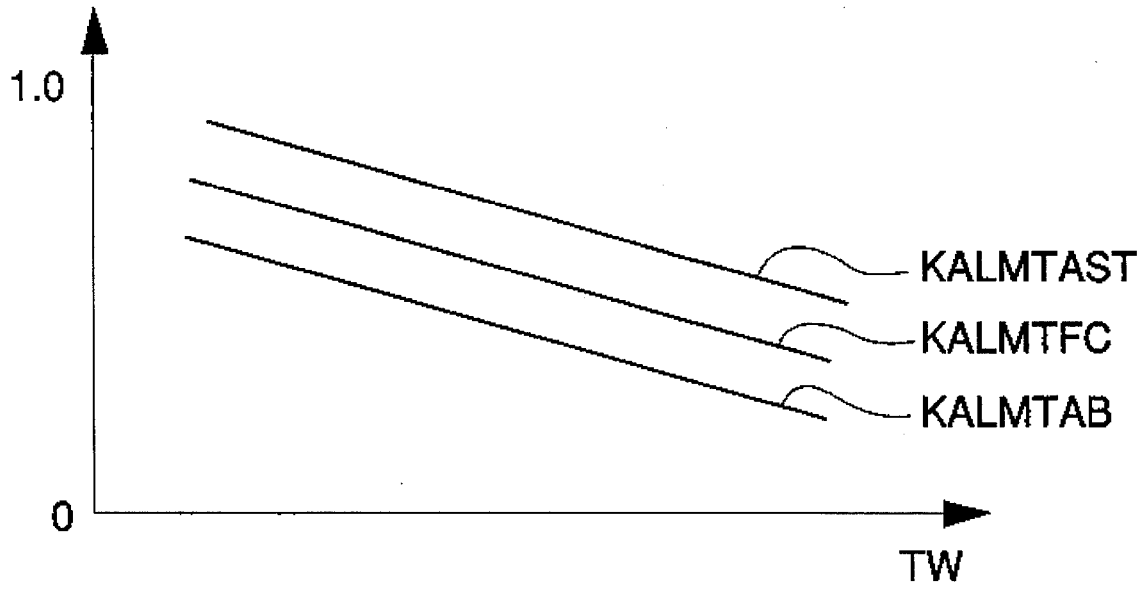
FIG. 13 shows a table of the relationship between lower limit value correction coefficients KALMTAST, KALMTFC and KALMTAB, and the engine coolant temperature Tw.

This routine is executed in synchronism with generation of each TDC signal pulse. First, it is determined at a step S510 whether or not the engine was in a starting mode in the immediately preceding loop. If the engine was in the starting mode, a correction value KA for the lower limit value of the direct supply ratio A is set to a lower limit value correction coefficient KALMTAST to be applied immediately after the start of the engine at a step S520, since the fuel injection amount calculated by the fuel injection amount-calculating routine of FIG. 6 can become unstable in a transient state of the engine such as immediately after the start of the engine. The lower limit value correction coefficient KALMTAST is a function of the engine coolant temperature Tw, as shown in FIG. 13, in which the lower limit value ALMTL0 is set to larger values as the engine coolant temperature TW is lower. In the present embodiment, the lower limit value correction coefficient KALMTAST to be applied immediately after the start of the engine is set to a value within a range of 0.75 to 0.78 in dependence on the engine coolant temperature Tw.

The lower limit value ALMTL0 of the direct supply ratio A is calculated according to the following equation (19), by the use of the lower limit value correction coefficient KALMT calculated at the step S520 and the direct supply ratio A calculated by the direct supply ratio A-calculating routine, described above, at a step S530:

$$ALMTL0=(1-A)\times KALMT+A \quad (19)$$

As shown at a time point al in FIG. 12, the lower limit value ALMTL0 to be applied immediately after the start of the engine is initially set to a relatively high value.

After calculation of the lower limit value ALMTL0, a counter NITDC2 is reset to a value "0" at a step S540, followed by terminating the present routine.

When in the next loop it is determined at the step S510 that the engine was not in the starting mode, it is determined at a step S550 whether or not fuel cut F/C (interruption of fuel supply) was carried out in the last loop. It no fuel cut F/C was carried out, the program proceeds to a step S580, wherein a determination is made as to whether or not the region determined by the direct supply ratio A and the fuel transfer delay ratio 1/T is the stable region. More specifically, it is determined whether or not the direct supply ratio A and the fuel transfer delay function ratio 1/T calculated by the direct supply ratio A-calculating routine and the fuel transfer delay time constant T-calculating routine fall within the stable region (1) in FIG. 8. If they fall within the stable region (1), it is determined at a step S590 whether or not the count value of the counter NITDC2 exceeds a predetermined value NTDCT2.

If the count value exceeds the predetermined value NTDCT2, the count value is incremented by 1 at a step S600, followed by terminating the present routine. If the count value exceeds the predetermined value NTDC2, the count value is reset to "0" at a step S610, and then the lower limit value ALMTL0 is decremented by a predetermined value ΔALMT at a step S620. Then, whether or not the decremented lower limit ALMTL0 has reached a predetermined lower limit value ALMTL is determined at a step S630. If it has not yet reached the ALMTL value, the routine is immediately terminated.

By thus decrementing the lower limit value ALMTL0 by the predetermined value ΔALMT whenever the present routine is repeatedly executed, the lower limit value ALMTL0 progressively decreases as shown by a2 in FIG. 12 toward the predetermined lower limit value ALMTL (e.g. 0.125).

After it is determined at the step S630 that the lower limit value ALMTL0 has decreased to the predetermined lower limit value ALMTL, the ALMTL0 value is held at the predetermined lower limit value ALMTL by limit checking at a step S640, as shown by a3 in FIG. 12. That is, insofar as the engine operating condition remains unchanged, the lower limit value ALMTL0 is held at the predetermined lower limit value ALMTL. In this way, by initially setting the lower limit value ALMTL0 to a relatively high value immediately after the start of the engine and thereafter progressively decreasing it, the direct supply ratio A can be positively set within the stable region (1) in FIG. 8 without affecting the drivability of the engine.

On the other hand, if it is determined at the step S550 that the engine was under fuel cut F/C in the last loop, it is determined at a step S560 whether or not a variation amount ΔTH in the throttle valve opening is smaller than a lower limit value ΔTHGA. If the throttle valve opening variation ΔTH is smaller than the lower limit value ΔTHGA, that is, when the engine has just left an idling condition, the lower limit value correction value KALMT for the direct supply ratio A is set to a lower limit value correction coefficient KALMTFC to be applied immediately after recovery from fuel cut F/C, at a step S570. Also this lower limit value correction coefficient KALMTFC is a function of the engine coolant temperature Tw and set to larger values as the engine coolant temperature Tw is lower, as shown in FIG. 13. In the present embodiment, the correction coefficient KALMTFC is set to a value within a range of 0.55 to 0.65.

The lower limit value ALMTL0 calculated by the use of the lower limit value correction coefficient KALMTFC to be applied immediately after recovery from fuel cut F/C initially exhibits an increase as shown at a time point a4 in FIG. 12 and thereafter progressively decreases as shown by a5 in FIG. 12 as the steps S590 to S640 are repeatedly executed, and eventually becomes held at the predetermined lower limit value ALMTL.

When the engine is in an operating condition other than immediately after the start of the engine and immediately after recovery from fuelcut F/C, if it is determined at the step S580 that the direct supply ratio A and/or the fuel transfer delay ratio 1/T does not fall within the stable region (1) in FIG. 8, the lower limit value correction coefficient KALMT is set to a lower limit value correction coefficient KALMTAB (e.g. 0.45–0.50) to be applied for a region other than the stable region at a step S650, to set the lower limit value ALMTL0 to a relatively high value, similarly to the above cases. Also the lower limit value correction coefficient KALMTAB is a function of the engine coolant temperature Tw and set to larger values as the engine coolant temperature Tw is lower, as shown in FIG. 13. Thereafter, the steps S590 to S640 are repeatedly executed so that eventually the lower limit value ALMTL0 becomes held at the predetermined lower limit value ALMTL.

As described above, according to the present embodiment, when the engine is in a transient state such as immediately after the start of the engine, immediately after recovery from fuel cut F/C and other operating conditions where the direct supply ratio A and/or the fuel transfer delay ratio 1/T falls outside the stable region, the lower limit value ALMTL0 of the direct supply ratio A is corrected to a higher value, the condition of $A>\frac{1}{2}\times 1/T$ of the inequalities (15) can be more likely to be satisfied. As a result, the fuel injection amount can be stably calculated by using the direct supply ratio A and the fuel transfer delay ratio 1/T satisfying the stable region in FIG. 8.

Besides the direct supply ratio A, a lower limit value 1/TLMT0 of the fuel transfer delay ratio 1/T may also be corrected to a lower value so that the condition of $A>\frac{1}{2}\times 1/T$ is more likely to be satisfied. Also alternatively, both the direct supply ratio A and the fuel transfer delay ratio 1/T may be corrected at the same time.

Further, when the A-B method is employed, the direct supply ratio A or the evaporation ratio B may be corrected, or both the direct supply ratio A and the evaporation ratio B may be corrected, so that the condition of ½B<A of the inequalities (18) can be more likely to be satisfied.

What is claimed is:

1. In a fuel injection amount control system for an internal combustion engine having an intake passage having a wall surface, at least one combustion chamber, and fuel injection means for injecting fuel into said intake passage, including:

desired fuel amount-calculating means for calculating a desired amount of fuel to be supplied to each of said at least one combustion chamber in response to operating conditions of said engine;

parameter-calculating means for calculating values of parameters indicative of fuel adherence characteristics of an interior of said intake passage in response to operating conditions of said engine;

fuel amount-calculating means for calculating a first amount of fuel which is directly drawn into said each of said at least one combustion chamber from an amount of fuel injected by said fuel injection means, and a second amount of fuel which is carried off said wall surface of said intake passage due to evaporation and into said each of said at least one combustion chamber, from fuel adhering to said wall surface of said intake passage, based upon said values of said parameters indicative of said fuel adherence characteristics; and fuel injection amount-calculating means for calculating an injection amount of fuel to be injected by said fuel injection means, by correcting said desired fuel amount, based upon said first and second amounts of fuel, the improvement comprising:

operating condition-detecting means for detecting whether said engine is in a predetermined operating condition in which convergence of said fuel injection amount calculated by said fuel injection amount-calculating means to said desired fuel amount can be unstable; and parameter-correcting means for correcting a value of at least one of said parameters indicative of said fuel adherence characteristics in a manner such that said fuel injection amount stably converges to said desired fuel amount, when said engine is in said predetermined operating condition.

2. A fuel injection amount control system as claimed in claim 1, wherein said predetermined operating condition of said engine includes a transient condition of said engine.

3. A fuel injection amount control system as claimed in claim 2, wherein said predetermined operating condition of said engine includes an operating condition of said engine immediately after the start of said engine, and an operating condition of said engine immediately after recovery from interruption of fuel supply.

4. A fuel injection amount control system as claimed in claim 1, wherein said parameters indicative of said fuel adherence characteristics include a first parameter related to an amount of fuel injected by said fuel injection means and directly drawn into said each of said at least one combustion chamber, said parameter-correcting means correcting a value of said first parameter in a direction of increasing the value of said first parameter, when said engine is in said predetermined operating condition.

5. A fuel injection amount control system as claimed in claim 1, wherein said parameters indicative of said fuel adherence characteristics include a second parameter related to a time delay with which an amount of fuel adhering to said wall surface of said intake passage after being injected by said fuel injection means, is drawn into said each of said at least one combustion chamber by evaporation, said parameter-correcting means correcting a value of said second parameter in a direction of decreasing the value of said second parameter, when said engine is in said predetermined operating condition.

6. A fuel injection amount control system as claimed in claim 1, wherein said parameters indicative of said fuel adherence characteristics include a first parameter related to an amount of fuel injected by said fuel injection means and directly drawn into said each of said at least one combustion chamber, and a second parameter related to a time delay with which an amount of fuel adhering to said wall surface of said intake passage after being injected by said fuel injection means is drawn into said each of said at least one combustion chamber by evaporation, said parameter-correcting means correcting a value of said first parameter in a direction of increasing the value of said first parameter and a value of said second parameter in a direction of decreasing the value of said second parameter, when said engine is in said predetermined operating condition.

7. A fuel injection amount control system as claimed in claim 1, wherein said parameters indicative of said fuel adherence characteristics include a third parameter related to an amount of fuel adhering to said wall surface of said intake passage after being injected by said fuel injection means and and thereafter drawn into said each of said at least one combustion chamber by evaporation, said parameter-correcting means correcting a value of said third parameter in a direction of decreasing the value of said third parameter, when said engine is in said predetermined operating condition.

8. A fuel injection amount control system as claimed in claim 1, wherein said parameters indicative of said fuel adherence characteristics include a first parameter related to an amount of fuel injected by said fuel injection means and directly drawn into said each of said at least one combustion chamber, and a third parameter related to an amount of fuel adhering to said wall surface of said intake passage after being injected by said fuel injection means and thereafter drawn into said each of said at least one combustion chamber by evaporation, said parameter-correcting means correcting a value of said first parameter in a direction of increasing the value of said first parameter and a value of said third parameter in a direction of decreasing the value of said third parameter, when said engine is in said predetermined operating condition.

9. A fuel injection amount control system as claimed in claim 1, wherein said parameters indicative of said fuel adherence characteristics include a first parameter related to an amount of fuel injected by said fuel injection means and directly drawn into said each of said at least one combustion chamber, and a second parameter related to a time delay with which an amount of fuel adhering to said wall surface of said intake passage after being injected by said fuel injection means is drawn into said each of said at least one combustion chamber by evaporation, said operating condition-detecting means determining whether said engine is in said predetermined operating condition, based on a combination of the values of said first and second parameters.

10. A fuel injection amount control system as claimed in claim 1, wherein said parameters indicative of said fuel adherence characteristics include a first parameter related to an amount of fuel injected by said fuel injection means and directly drawn into said each of said at least one combustion chamber, and a third parameter related to an amount of fuel adhering to said wall surface of said intake passage after being injected by said fuel injection means and and thereafter drawn into said each of said at least one combustion chamber by evaporation, said operating condition-detecting means determining whether said engine is in said predetermined operating condition, based on a combination of the values of said first and third parameters.

11. A fuel injection amount control system as claimed in claim 9, wherein said predetermined operating condition of said engine is an operating region of said engine in which the following inequalities (1)–(3) are satisfied:

(1) $0<A<1.0$ (2) $0<1/T<1.0$ (3) $A>\frac{1}{2}\times 1/T$ where:

A=said first parameter;

1/T=said second parameter.

12. A fuel injection amount control system as claimed in claim 10, wherein said predetermined operating condition of said engine is an operating region of said engine in which the following inequalities (1)–(3) are satisfied:

(1) $0<A<1.0$ (2) $0<B<1.0$ (3) $\frac{1}{2}B<A$ where:

A=said first parameter;

B=said third parameter.

13. In a fuel injection amount control system for an internal combustion engine having an intake passage having a wall surface, at least one combustion chamber, and fuel injection means for injecting fuel into said intake passage, including:

desired fuel amount-calculating means for calculating a desired amount of fuel to be supplied to each of said at least one combustion chamber in response to operating conditions of said engine; and fuel injection amount-calculating means for calculating an injection amount of fuel to be injected by said fuel injection means, by correcting said desired fuel amount such that a sum of a first amount of fuel which is directly drawn into said each of said at least one combustion chamber from an amount of fuel injected by said fuel injection means, and a second amount of fuel which is carried off said wall surface of said intake passage due to evaporation and into said each of said at least one combustion chamber from fuel adhering to said wall surface of said intake passage is equal to said desired fuel amount, the improvement comprising:

operating condition-detecting means for detecting whether said engine is in a predetermined operating condition in which convergence of said fuel injection amount calculated by said fuel injection amount-calculating means to said desired fuel amount can be unstable; and suppressing means for suppressing correction of said desired fuel amount in a manner such that said fuel injection amount stably converges to said desired fuel amount, when said engine is in said predetermined operating condition.

14. A fuel injection amount control system as claimed in claim 13, wherein said suppressing means comprises:

parameter-calculating means for calculating values of parameters indicative of fuel adherence characteristics of an interior of said intake passage in response to operating conditions of said engine; and parameter-correcting means for correcting a value of at least one of said parameters indicative of said fuel adherence characteristics, when said engine is in said predetermined operating condition.

* * * * *